United States Patent [19]

Dobbs et al.

[11] Patent Number: 5,072,860

[45] Date of Patent: Dec. 17, 1991

[54] ANTI-LOOSENING SNAP-FIT CAP FOR DISPENSER

[75] Inventors: Douglas B. Dobbs, Yorba Linda; Richard P. Grogan, Downey; Elio Hernandez, W. Covina, all of Calif.

[73] Assignee: Calmar Inc., Watchung, N.J.

[21] Appl. No.: 500,126

[22] Filed: Mar. 28, 1990

[51] Int. Cl.[5] ..... B67D 5/40

[52] U.S. Cl. ..... 222/383; 222/545; 215/276; 277/215

[58] Field of Search ..... 215/276; 277/136, 137, 277/166, 215; 222/383, 523, 545, 553

[56] References Cited

U.S. PATENT DOCUMENTS

| | | | |
|---|---|---|---|
| Re. 29,916 | 2/1979 | Schmid et al. | 222/81 |
| 3,128,018 | 7/1961 | Corsette et al. | 222/321 |
| 3,179,306 | 3/1963 | Corsette | 222/321 |
| 3,650,473 | 3/1972 | Malone | 222/383 |
| 4,168,788 | 9/1979 | Quinn | 222/383 |
| 4,215,869 | 8/1980 | Pendleton | 277/215 |
| 4,361,256 | 11/1982 | Corsette | 222/383 |
| 4,747,498 | 5/1988 | Goch | 215/232 |
| 4,944,431 | 7/1990 | Blake | 222/345 |

*Primary Examiner*—Michael S. Huppert
*Assistant Examiner*—Shari M. Wunsch
*Attorney, Agent, or Firm*—Watson, Cole, Grindle & Watson

[57] ABSTRACT

A closure cap snap-fitted to the lower end of a dispenser body is threaded to the neck of a container of fluid to be dispensed and resists back-off or loosening from the container by resisting rotation of the body about the central axis of the container. Cooperating slip-resistant surfaces are provided between an edge wall of a flexible skirt on the cap and a confronting flange on the body. Rotation of the body is further resisted by the provision of slip-resistant cooperating surfaces between opposing sides of a gasket seal and the respective lower and upper confronting surface of the dispenser body and the container neck.

4 Claims, 1 Drawing Sheet

ANTI-LOOSENING SNAP-FIT CAP FOR DISPENSER

BACKGROUND OF THE INVENTION

This invention relates generally to a hand operated dispenser having a snap-fitted, internally threaded closure cap for mounting the dispenser on the neck of the container of fluid to be dispensed. More particularly, the threaded closure cap is prevented from loosening after being tightened on the container.

The present invention comprises on improvement over U.S. Pat. No. 4,361,256 disclosing a threaded closure cap snap-fitted to the dispenser body for mounting the body to a threaded container neck. The lower end of the dispenser body has an external annular flange, and the closure cap has a flexible conical skirt in snap-fitting engagement with the flange for positively retaining the body and the cap together. On tightening the closure on the container neck, i.e., "torquing down", the flexible conical skirt on the cap deforms to some extent to enhance the tight seal between the body and the container neck, and to improve upon the tight engagement between the cap and the lower portion of the pump body. A gasket seal may be interposed between the lower end of the pump body and the upper end of the container neck which may be slightly compressed as the closure cap is tightened down.

Problems have been uncountered in the use of such a snap-fitted closure cap in that after assembling the dispenser body to the container, the tightened closure cap tends to back-off or loosen especially during shipment and storage thereby causing leakage of product from the container. For example, vibrations during shipment can cause the closure cap to loosen as the compressed gasket seal slips and relaxes. Likewise, should the pump body reorient itself on the container during shipment or during handling prior to shipment, torque back-off has been experienced upon turning movement of the dispenser body about the central axis of the container in a loosening direction. Moreover, during use of the dispenser, it may be necessary to reorient the dispenser body relative to the container such that, if turned in a loosening direction, the closure cap tends to back off causing leakage.

SUMMARY OF THE INVENTION

It is therefore an object of the present invention to provide a dispener having a snap-fitted closure of the aforedescribed type but which resists rotation of the dispenser body and/or slippage of the gasket seal about the central axis of the container to thereby avoid any loosening of the tightened closure cap from the container neck which may cause leakage.

According to one feature of the invention, a terminal edge of the deformable skirt of the cap which engages the dispenser body flange is roughened, and the surface of the flange engaged by this terminal edge is likewise roughened to thereby resist rotation of the dispenser body relative to the cap.

Another feature provides for resistance to rotation of the dispenser body relative to the container neck by the provision of ratchet teeth or other slip resistant means on the lower edge of the dispenser body which overlies the container neck and on the upper edge of the container neck, with a gasket disposed therebetween and in engagement with such slip resistant means. The gasket seal can itself have ratchet teeth or other slip resistant means on opposing sides in locking engagement with the dispenser body and container neck teeth, or the gasket seal can be of deformable material made to deform upon engagement with the ratchet teeth upon a tightening of the closure cap. Any slippage of the gasket seal is thus prevented.

Other objects, advantages and novel features of the invention will become more apparent from the following detailed description of the invention when taken in conjunction with the accompanying drawings.

DETAILED DESCRIPTION OF THE INVENTION

Figure 1:
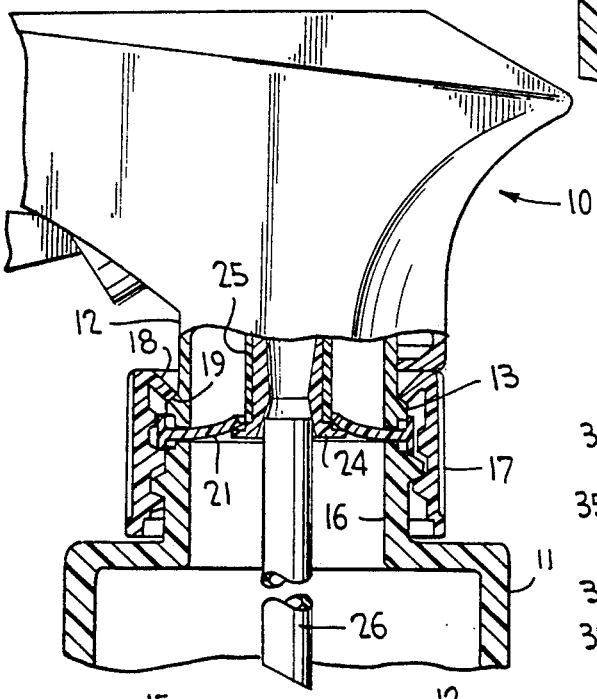
FIG. 1 is a side elevational view, partly in section, of a dispenser body having a snap-fitted closure cap for mounting the body onto the neck of a container, and incorporating the rotational resistance features of the invention.

Turning now to the drawings where in like reference characters refer to like and corresponding parts throughout the several views, a dispenser 10 is generally illustrated in FIG. 1, the dispenser being of the trigger operated type for the dispensing of a fluid upon pumping operation. The dispenser is mounted on a container 11 of fluid to be dispensed upon operation of the dispenser. Although a trigger actuated dispenser is disclosed, the present invention is adapted for use with other types of dispensers such as finger actuated dispensers and squeeze bottles, without departing from the invention.

The dispenser has a cylindrical attaching portion 12 with an external annular flange 13 adjacent its lower end wall 14. Upper annular wall 15 of flange 13 is conical as clearly shown in FIGS. 1 and 2.

The dispenser body is mounted on externally threaded neck 16 of the container by the provision of a closure cap 17 having internal threads which engage the external threads on the neck. The closure cap has a central opening bounded by an annular skirt or lip 18 to facilitate snap-fit engagement of the cap to portion 12 of the dispenser body. The skirt is conical presenting a terminal edge wall 19. And, the skirt is sufficiently flexible to permit the cap to be inserted over attaching portion 12 as the skirt flexs during the insertion process. The dispenser body and closure cap are thus snap-fitted in place with terminal edge wall 19 bearing against upper wall 15 of flange 13.

Figure 3:
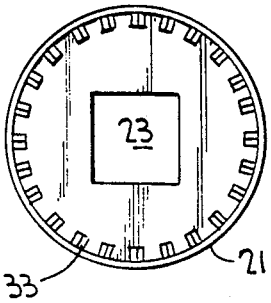
FIGS. 3 and 4 are, respectively, plan views taken along the lines 3—3 and 4—4 of FIG. 2.

A gasket seal 21 is positioned between lower edge wall 14 of the attaching portion and upper edge wall 22 of container neck 16. The gasket has a central opening 23 (FIG. 3), and is mounted to the dispenser body via a tube retainer 24 inserted within an inner sleeve 25 of the dispenser body, the tube retainer suspending a dip tube 26 extending into the container through which fluid is suctioned during pumping upon operation of trigger actuator 27.

Figure 7:
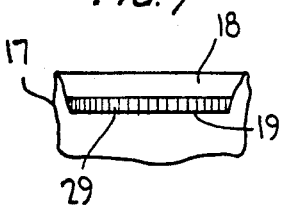
FIG. 7 is a view taken substantially along the line 7—7 of FIG. 5.
Figure 8:
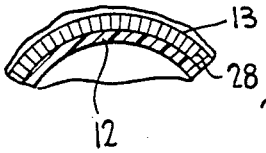
FIG. 8 is a view taken substantially along the line 8—8 of FIG. 5.

As clearly shown in FIG. 8, the surface of conical upper wall 15 of flange 13 is roughened such as by the provision of tiny radially extended ribs 28 or other slip-resistant means. And, as shown in FIG. 7, terminal edge wall 19 of flexible skirt 18 of the closure cap is roughened as by the provision of tiny radially extended ribs 29 or other slip-resistant means. Therefore, as the closure cap is tightened down on the container neck, ribs 28 and 29 cooperate by interengaging to resist rotation of the dispenser body about the central axis of attaching portion 12 (i.e., the central axis of the container). In such manner there is less of a tendency for the tightened closure cap to loosen and consequently cause leakage of product from the container.

Figure 6:
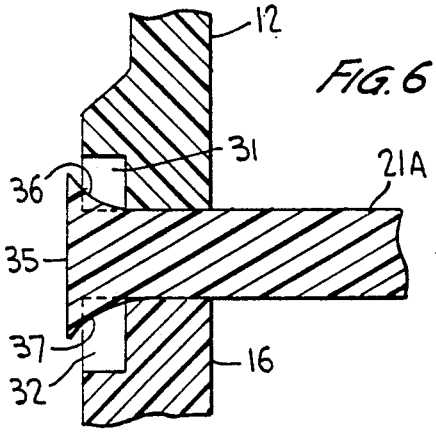
FIG. 6 is an enlarged view of the inventive feature of FIG. 5.
Figure 2:
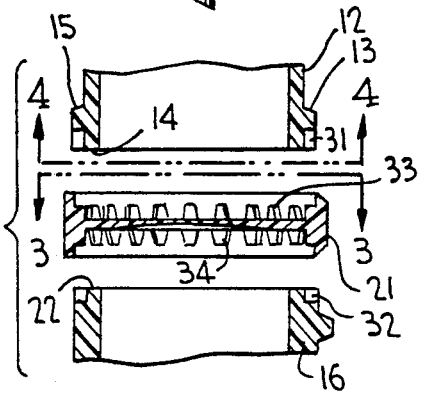
FIG. 2 is a expanded view similar to FIG. 1 illustrating the details of one of the features of the invention.
Figure 4:
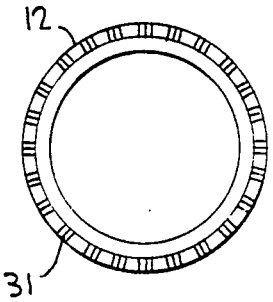

In accordance with another feature of the invention, the surface of the lower edge wall 14 of attaching portion 12 is provided with ratchet teeth 31, and the surface of the upper edge wall 22 of container neck 16 is likewise provided with ratchet teeth 32. And, opposing surfaces of gasket seal 21 are provided with ratchet teeth 33, 34, as illustrated in detail in FIGS. 2, 3 and 4. Thus, upon assembly as shown in FIG. 1, ratchet teeth 31, 33 interengage and ratchet teeth 34, 32 interengage upon a tightening of the closure cap on the container neck. These interengagements serve to immobilize the gasket seal against rotation and to resist rotation of the dispenser body relative to the container about the central axis of attaching portion 12 to thereby avoid any loosening of the tightened closure cap from the container neck. As shown in FIGS. 2 and 4, lower edge wall 14 has an inner annular sealing surface portion lying adjacent an outer annular portion containing ratchet teeth 31. Similarly, upper edge wall 22 has an inner annular sealing surface portion lying adjacent an outer annular portion containing ratchet teeth 32. And, smooth opposing surfaces of gasket 21 sealingly engage the respective inner surface portions of edges 14 and 22 as shown in FIGS. 1 and 6. Ratchet teeth 33 and 34 of the gasket respectively engage teeth 31 and 32 in the assembled condition of FIG. 1.

Figure 5:
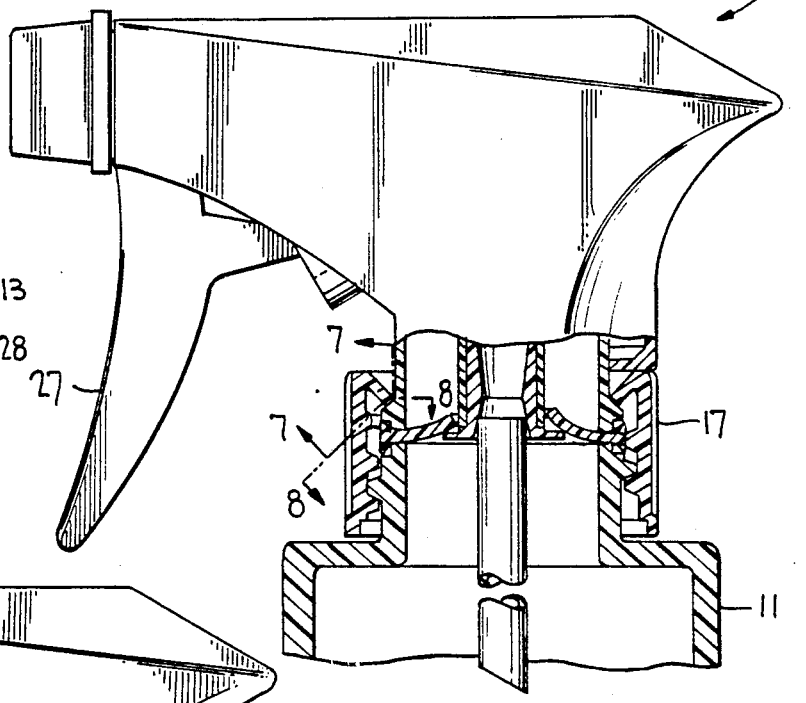
FIG. 5 is a view similar to FIG. 1 incorporating another embodiment according to the invention.

An alternative embodiment is illstrated in FIGS. 5 and 6 wherein gasket seal 21A is instead fluted along its outer periphery as shown to thereby present an enlargement 35 having flaring portions 36 and 37. And, gasket seal 21A is of a relatively soft material such as a foamed polyethylene such that, when assembled as shown in FIG. 5, ratchet teeth 31 and 32 bite into and deform flaring portions 36 and 37 for immobilizing the gasket seal against rotation and for resisting rotation of the dispenser body about the central axis of attaching portion 12 relative to the container. By immobilizing the gasket seal and by resisting dispenser body rotation, there is less of a tendency for the closure cap to back off from the container neck. Leakage of product from the container is therefore minimized.

From the foregoing it can be seen that a simple and economical yet highly effective approach has been taken in avoiding a loosening or "torque backoff" of the tightened closure cap after assembly. Thus, should the assembled dispenser/container be subject to vibrations or impact during storage and shipment, there is less of a tendency according to the invention for the closure cap to loosen. And, any tendency of the dispenser body to rotate about the central axis of its attaching portion relative to both the closure cap and relative to the container, is substantially resisted. Thus, any loosening of the tightened closure cap after assembly and any resulting leakage of product from the container, is avoided.

Obviously, many other modifications and variations of the present invention are made possible in the light of the above teaching. For example, ratchet teeth 31 to 34 can be replaced by roughened surfaces or ribs or other slip-resistant surfaces without departing from the invention. It is therefore to be understood that within the scope of the appended claims the invention may be practiced otherwise than as specifically described.

What is claimed is:

1. A dispenser having an anti-loosening snap-fit closure cap mounted on a container of product to be dispensed, comprising, a dispenser body having a cylindrical attaching portion, an external flange on said portion having an upper annular wall, a freely rotatable, internally threaded closure cap having a flexible conical skirt at one end in snap-fitting engagement with said flange for positively retaining said cap on said dispenser, the container having an externally threaded neck in threaded engagement with said cap, said attaching portion having a lower edge wall overlying an upper edge wall of said container neck, said skirt having a terminal edge wall in tight engagement with said upper annular wall upon tightening said cap onto said container neck, said lower edge wall comprising an inner annular sealing surface portion and an outer annular portion containing ratchet teeth, said upper edge wall comprising an inner annular sealing surface portion and an outer annular portion containing ratchet teeth, a gasket disposed between said lower and upper edge walls, said gasket having opposed smooth surfaces respectively in sealing engagement with said inner surface portions, said gasket further having opposed portions containing ratchet teeth respectively in engagement with said ratchet teeth of said outer portions of said lower and upper edge walls for resisting rotation of said body relative to said container about a central axis of said attaching portion to avoid any loosening of said tightened cap from said neck and to maintain the sealing engagement between said gasket and said inner surface portions.

2. The dispenser according to claim 1, further comprising cooperating anti-slip means on said terminal edge wall and on said annular wall for resisting rotation of said body relative to said cap about said central axis to further avoid any loosening of said tightened cap from said neck and to further maintain the sealing engagement between said gasket and said inner surface portions.

3. A dispenser having an anti-loosening snap-fit closure cap mounted on a container of product to be dispensed, comprising, a dispenser body having a cylindrical attaching portion, an external flange on said portion having an upper annular wall, a freely rotatable, internally threaded closure cap having a flexible conical skirt at one end in snap-fitting engagement with said flange for positively retaining said cap on said dispenser, the container having an externally threaded neck in threaded engagement with said cap, said attaching portion having a lower edge wall overlying an upper edge wall of said container neck, said skirt having a terminal edge wall in tight engagement with said upper annular wall upon tightening said cap onto said container neck, said lower edge wall comprising an inner annular sealing surface portion and an outer annular portion containing ratchet teeth, said upper edge wall comprising an inner annular sealing surface portion and an outer annular portion containing ratchet teeth, a gasket disposed between said lower and upper edge walls, said gasket having opposed smooth surfaces respectively in sealing engagement with said inner surface portions, said gasket further having an outer annular portion of deformable material in engagement with said ratchet teeth of said lower and upper edge walls, said material deforming upon said engagement for resisting rotation of said body relative to said container about a central axis of said attaching portion to avoid any loosening of said tightened cap from said neck and to maintain the sealing engagement between said gasket and said inner surface portions.

4. The dispenser according to claim 3, further comprising cooperating anti-slip means on said terminal edge wall and on said annular wall for resisting rotation of said body relative to said cap about said central axis to further avoid any loosening of said tightened cap from said neck and to further maintain the sealing engagement between said gasket and said inner surface portions.

* * * * *